United States Patent [19]

Richter et al.

[11] Patent Number: 4,940,047

[45] Date of Patent: Jul. 10, 1990

[54] TEXTILE SHEET-LIKE STRUCTURE WITH REACTIVE RESIN

[75] Inventors: Roland Richter, Cologne; Wolfram Mayer, Odenthal-Glöbusch; Günter Langen, Wolfstein; Willy Leyser, Bedesbach, all of Fed. Rep. of Germany

[73] Assignees: Bayer Aktiengesellschaft, Leverkusen; Karl Otto Braun KG, Wolfstein, both of Fed. Rep. of Germany

[21] Appl. No.: 208,348

[22] Filed: Jun. 17, 1988

[30] Foreign Application Priority Data

Jun. 24, 1987 [DE] Fed. Rep. of Germany ..... 3720762
Aug. 7, 1987 [DE] Fed. Rep. of Germany ..... 3726268

[51] Int. Cl.[5] ..... A61F 5/04

[52] U.S. Cl. ..... 128/90; 26/18.5; 156/307.3; 156/307.7; 156/308.4; 422/68; 422/74; 422/224; 422/231; 422/265; 422/267; 422/290; 422/423.5; 422/423.7; 422/253; 422/254

[58] Field of Search ..... 428/267, 265, 423.5, 428/423.7, 264, 290, 253, 254, 231, 68, 74, 224; 53/416; 156/307.3, 307.7, 308.4; 128/90; 26/18.5

[56] References Cited

U.S. PATENT DOCUMENTS

| | | | |
|---|---|---|---|
| 4,560,611 | 12/1985 | Naka et al. | 428/265 |
| 4,594,286 | 6/1986 | McKinney et al. | 428/265 |
| 4,609,578 | 9/1986 | Reed | 428/251 |
| 4,613,537 | 9/1986 | Krüpper | 428/254 |
| 4,668,563 | 5/1987 | Buese et al. | 428/254 |
| 4,710,423 | 12/1987 | Imamura | 428/265 |
| 4,745,912 | 5/1988 | McMurray | 428/254 |
| 4,758,465 | 7/1988 | McKinney et al. | 428/265 |
| 4,793,330 | 12/1988 | Honeycutt et al. | 428/254 |

*Primary Examiner*—James J. Bell
*Attorney, Agent, or Firm*—Sprung Horn Kramer & Woods

[57] ABSTRACT

Textile sheet-like structure impregnated or coated with water-hardening synthetic resin, said textile comprising organic fibers with an elasticity modulus of 200 to 2500 daN/mm$^2$ and having an extensibility in the longitudinal direction of at least 10% before hardening of said resin is useful in preparing orthopaedic support dressings, containers, filters, pipes, reinforcing material, stiffening material, filler or sealer material for hollow spaces or joints, insulating material, in preparing decorative and artistic articles.

19 Claims, No Drawings

TEXTILE SHEET-LIKE STRUCTURE WITH REACTIVE RESIN

The invention relates to construction materials, in particular for medical support dressings or technical devices, which, in addition to a transverse elasticity, also have a longitudinal elasticity, a process for their preparation and their use.

The construction materials according to the invention in general consist of a carrier layer which is coated and/or impregnated with a reactive resin.

The construction materials according to the invention can in general be used for stiffening, shaping and sealing in the medical or technical sector.

However, the construction materials according to the invention can also be used for the production of containers, filters or pipes, for joining construction elements, for manufacture of decorative or artistic articles, for stiffening purposes or as a filler or sealing material for joints and hollow spaces.

BACKGROUND OF THE INVENTION

Construction materials which consist of a flexible carrier coated or impregnated with a water-hardening reactive resin are already known. An example which may be mentioned is DE-A-2,357,931, which describes construction materials of flexible carriers, such as knitted fabrics, woven fabrics or non-wovens, which are coated or impregnated with water-hardening reactive resins, such as isocyanates or prepolymers modified by isocyanate groups. Carrier materials of glass fibres have been used to increase the strength of these construction materials (U.S. Pat. No. 4,502,479). However, these known carrier materials are only extensible in the transverse direction, but are virtually rigid in the longitudinal direction, in order thus to achieve a greater stability (U.S. Pat. No. 4,502,479, column 3, lines 45 to 47).

A disadvantage of the carrier materials which can be extended only in the transverse direction is the occurrence of folds when the material is applied to an uneven surface with conical elevations or variable radii, for example a human leg.

In U.S. Pat. No. 4,609,578, Raschel and tricot knitted fabrics of glass fibres which are processed in a certain manner of knitting are mentioned as carriers for construction materials. Apart from the transverse extension, these carriers have a longitudinal extension of at least 22 to 25%. The longitudinal extension of these knitted fabrics arises because of a certain type of laying during stitch formation and the high restoring force of the glass fibres (elasticity modulus 7000 to 9000 [daN/mm$^2$]).

Construction materials based on glass fibres such as are described in U.S. Pat. No. 4,609,578 have the disadvantage of poor X-ray transparency. They also develop sharp edges at the points of break, leading to injuries. Another disadvantage is the occurrence of glass dust during preparation and removal of the construction material.

Construction materials such as are described in U.S. Pat. No. 4,609,578 cannot be prepared with fibres other than glass fibres. Fibres other than glass fibers have considerably lower elasticity moduli, so that carriers of comparable longitudinal and transverse extension are not obtained.

BRIEF DESCRIPTION OF THE INVENTION

Textile sheet-like structures which are impregnated and/or coated with a water-hardening reactive resin have been found, and are characterized in that they consist of organic fibres with an elasticity modulus of 200 to 2500 daN/mm$^2$ and have an extensibility in the longitudinal direction of more than 10% before hardening.

DETAILED DESCRIPTION

The present invention relates to a textile sheet-like structure impregnated or coated with water-hardening synthetic resin, with the textile comprising organic fibers having an elasticity modulus of 200 to 2500 daN/mm$^2$ and having an extensibility in the longitudinal direction of at least 10% before hardening of said resin. The impregnated or coated structure is useful in preparing orthopaedic support dressings, containers, filters, pipes, reinforcing material, stiffening material, filler or sealer material for hollow spaces or joints, insulating material, in preparing decorative and artistic articles.

Surprisingly, apart from an extension in the transverse direction, the sheet-like structures according to the invention also have an extension in the longitudinal direction.

The longitudinal direction as a rule means the processing direction of the textile, that is to say, for example, the direction of the warp or wale.

Transverse direction as a rule means perpendicular to the processing direction of the textile, that is to say in the direction of the weft or stitches course.

The sheet-like structures according to the invention can be present in various geometric shapes. They are preferably in tape form, the long side of the tape corresponding to the processing direction of the textile.

Organic fibres for the sheet-like structures according to the invention can be natural fibres or chemical fibres.

Natural fibres which may be mentioned in particular are fibres from plant hair, such as cotton, bast fibres, such as hemp and jute, and hard fibres, such as sisal. Cotton fibres are particularly preferred.

Chemical fibres which may be mentioned in particular are fibres of synthetic polymers. Examples which may be mentioned are polymer fibres, such as polyethylene, polypropylene, polychloride (for example polyvinyl chloride and polyvinylidene chloride), polyacrylate and vinylate fibres, polycondensates fibres, such as polyamide, polyester and polyurea fibres, and polyaddition fibres, such as spandex or elastane fibres.

It is also possible to use viscose fibres.

It is also possible to use elastodiene threads (rubber threads).

Preferred synthetic fibres are fibres of polyesters, polyamides and polyacrylonitriles.

It is of course also possible to use sheet-like structures of various fibres.

Sheet-like structures of polyester and/or polyamide and/or cotton fibres are particularly preferred.

The fibres for the sheet-like structures according to the invention are known per se (Synthesefasern (Synthetic Fibres), pages 3 to 10 and 153 to 221 (1981), Verlag Chemie, Weinheim).

The thread system which is preferably incorporated in the longitudinal direction allows elastic extension in the longitudinal direction after the shrink process. If filaments of natural fibres are used, highly twisted yarns or twines of staple fibre yarns with a twist coefficient $\alpha$ of between 120 and 600 are preferred, so that the high degree of twist gives a high torsional moment and thus a snarling tendency. The twist coefficient $\alpha$ is calculated from $$\alpha = T\sqrt{\frac{TEX}{1000}},$$

wherein T denotes the number of turns per m of yarn or twine and TEX is the linear density of the yarn in g per 1000 m of yarn. To avoid undesirable twisting of the textile sheet-like structure, the threads are preferably incorporated with a varying direction of twist (in the clockwise direction: S twist, counterclockwise direction: Z twist) in alternating sequence, for example one thread S-1 thread Z or 2 threads S-2 threads Z.

Both, threads of natural rubber (elastodiene) and synthetic polyurethane elastomer threads (elastane) can be used as the permanently elastic threads.

To achieve the longitudinal extensibility, polyfilament texturized filament yarns of polyester, polyamide and the like are used as the chemical fibres.

The elastic properties of these yarns are based on the permanent crimping and torsion of the threads obtained in the texturizing process and achieved as a result of the thermoplastic properties of the materials. All types of texturized filaments can be used, such as, for example, HE yarns (highly elastic crimped yarns), set yarns and HB yarns (highly bulked yarns).

The thread yarns system incorporated in the longitudinal direction is held together by connecting threads, it being possible to use both staple fibre yarns or twines of natural fibres and staple fibre yarns or polyfilament yarns (smooth yarn) of chemical fibres. The strength of these yarns is characterized by the elasticity modulus (E modulus).

The fibres for the sheet-like structures according to the invention have an elasticity modulus (E modulus) in the longitudinal direction of 200 to 2500, preferably 400 to 2000 daN/mm$^2$. The elasticity modulus can be determined by known methods (Synthesefasern (Synthetic Fibres), pages 63 to 68 (1981), Verlag Chemie, Weinheim).

The textile sheet-like structures according to the invention in general have an extensibility in the longitudinal direction of more than 10, preferably 15 to 200% and particularly preferably 15 to 80%, before hardening of the reactive resin. Extensibility in the longitudinal direction is understood as the longitudinal change, in comparison with the completely slack sheet-like structure, achieved when the textile sheet-like structure is loaded in the longitudinal direction with 10N per cm of width. Such measurements can be carried out, for example, in accordance with DIN (German Standard Specification) 61 632 (April 1985).

The sheet-like structures according to the invention in general have an extensibility in the transverse direction of 20 to 300%, preferably 40 to 200%, before hardening of the reactive resin.

The textile sheet-like structures according to the invention in general have a weight per square meter of 40 to 300 g, preferably 100 to 200 g.

Textile sheet-like structures of fibres of synthetic polymers are particularly preferred according to the invention. In the case where plant fibres are used, mixed textiles are preferred, a fibre of a synthetic polymer being used in the longitudinal direction and a plant fibre being used in the transverse direction.

Textiles of fibres of synthetic polymers or mixed textiles of synthetic polymers in the longitudinal direction and plant fibres in the transverse direction, the longitudinal extension of which has been established by a shrinking process, are preferred sheet-like structures according to the invention.

The shrinking process starts after activation of the textile sheet-like structure or of the yarns contained therein, it being possible for the activation to be achieved, for example, with the aid of the following methods:

(a) heat treatment with hot air in the temperature range from 80° to 250° C.,
(b) heat treatment with steam or superheated steam in the temperature range from 100° to 180° C. and
(c) wet treatment of the textile sheet-like structure using suitable liquid media, for example water or alcohol, if appropriate in the presence of auxiliaries (for example surfactants).

Textile sheet-like structures which contain in the longitudinal direction polyfilament, texturized filament threads of chemical fibres, such as polyester, polyamide or polyacrylonitrile fibres, which have been subjected to heat shrinking, and consist in the transverse direction of natural fibres or chemical fibres with an elasticity modulus of 400 to 2000 daN/mm$^2$, preferably of fibres of high-strength polyethylene terephthalates with an elasticity modulus of 900 to 2000 daN/mm$^2$ are particularly preferred here.

The processing forms of the textile sheet-like structures according to the invention can be woven fabrics, knitted fabrics, stitched fabrics or non-wovens. Knitted fabrics, such as warp knitted fabrics, Raschel knitted fabrics and tricot knitted fabrics may be mentioned as preferred. Raschel knitted fabrics are particularly preferred.

Water-hardening reactive resins are preferably resins based on polyurethane or polyvinyl resin.

Water-hardening polyurethanes which are possible according to the invention are all the organic polyisocyanates which are known per se, that is to say any desired compounds or mixtures of compounds which contain at least two organically bonded isocyanate groups per molecule. These include both low molecular weight polyisocyanates with a molecular weight of less than 400 and modification products of such low molecular weight polyisocyanates with a molecular weight which can be calculated from the functionality and the content of functional groups of, for example, 400 to 10,000, preferably 600 to 8,000 and in particular 800 to 5,000. Examples of suitable low molecular weight polyisocyanates are those of the formula $$Q(NCO)_n$$

in which n denotes 2 to 4, preferably 2 to 3, and Q denotes an aliphatic hydrocarbon radical with 2 to 18, preferably 6 to 10, C atoms, a cycloaliphatic hydrocarbon radical with 4 to 15, preferably 5 to 10, C atoms, an aromatic hydrocarbon radical with 6 to 15, preferably 6 to 13, C atoms or an araliphatic hydrocarbon radical with 8 to 15, preferably 8 to 13, C atoms.

Such suitable low molecular weight polyisocyanates are, for example, hexamethylene diisocyanate, dodecane 1,12-diisocyanate, cyclobutane 1,3-diisocyanate, cyclohexane 1,3- and 1,4-diisocyanate and any desired mixtures of these isomers, 1-isocyanato-3,3,5-trimethyl-5-isocyanatomethylcyclohexane, hexahydrotoluylene 2,4- and 2,6-diisocyanate and any desired mixtures of these isomers, hexahydrophenylene 1,3- and/or 1,4-diisocyanate, perhydrodiphenylmethane 2,4'- and/or 4,4'-diisocyanate, phenylene 1,3- and 1,4-diisocyanate, toluylene 2,4- and 2,6-diisocyanate and any desired mixtures of these isomers, diphenylmethane 2,4'- and/or 4,4'-diisocyanate, naphthylene 1,5-diisocyanate, triphenylmethane 4,4',4''-triisocyanate or polyphenylpolymethylene polyisocyanates such as are obtained by aniline-formaldehyde condensation and subsequent phosgenation.

Suitable higher molecular weight polyisocyanates are modification products of such simple polyisocyanates, that is to say polyisocyanates with, for example, isocyanurate, carbodiimide, allophanate, biuret or uretdione structural units, such as can be prepared by processes which are known per se from the prior art using the simple polyisocyanates of the abovementioned general formula given by way of example. Of the higher molecular weight modified polyisocyanates, the prepolymers known from polyurethane chemistry which have terminal isocyanate groups and are in the molecular weight range from 400 to 10,000, preferably 600 to 8,000 and in particular 800 to 5,000, are of particular interest. These compounds are prepared in a manner which is known per se by reaction of excess amounts of simple polyisocyanates of the type mentioned by way of example with organic compounds with at least two groups which are reactive towards isocyanate groups, in particular organic polyhydroxy compounds. Such suitable polyhydroxy compounds are either simple polyhydric alcohols, such as, for example, ethylene glycol, trimethylolpropane, propane-1,2-diol or butane-1,2-diol, or in particular higher molecular weight polyetherpolyols and/or polyesterpolyols of the type known per se from polyurethane chemistry, which have molecular weights of 600 to 8,000, preferably 800 to 4,000, and at least two, as a rule 2 to 8 but preferably 2 to 4, primary and/or seconday hydroxyl groups. Those NCO prepolymers which are obtained, for example, from low molecular weight polyisocyanates of the type mentioned by way of example and less preferred compounds with groups which are reactive towards isocyanate groups, such as, for example, polythioetherpolyols, polyacetals containing hydroxyl groups, polyhydroxypolycarbonates, polyester amides containing hydroxyl groups or copolymers, containing hydroxyl groups, of olefinically unsaturated compounds, can of course also be used. Examples of compounds which are suitable for the preparation of the NCO prepolymers and have groups which are reactive towards isocyanate groups, in particular hydroxyl groups, are the compounds disclosed by way of example in U.S. Pat. No. 4,218,543, column 7, line 29 to column 9, line 25. In the preparation of the NCO prepolymers, these compounds with groups which are reactive towards isocyanate groups are reacted with simple polyisocyanates of the type mentioned above by way of example, an NCO/OH equivalent ratio of $>1$ being maintained. The NCO prepolymers in general have an NCO content of 2.5 to 30, preferably 6 to 25% by weight. It can already be seen from this that, in the context of the present invention, "NCO prepolymers" and "prepolymers with terminal isocyanate groups" are to be understood as meaning both the reaction products as such and their mixtures with excess amounts of unreacted starting polyisocyanates, which are often also called "semiprepolymers".

Polyisocyanate components which are particularly preferred according to the invention are the technical polyisocyanates customary in polyurethane chemistry, that is to say hexamethylene diisocyanate, 1-isocyanato-3,3,5-trimethyl-5-isocyanatomethyl-cyclohexane (isophorone diisocyanate, abbreviated to: IPDI), 4,4'-diisocyanato-dicyclohexylmethane, 4,4'-diisocyanatodiphenylmethane, mixtures thereof with the corresponding 2,4'- and 2,2'-isomers, polyisocyanate mixtures of the diphenylmethane series such as can be obtained in a manner which is known per se by phosgenation of aniline/formaldehyde condensates, the modification products of these technical polyisocyanates which contain biuret or isocyanurate groups, and in particular NCO prepolymers of the type mentioned based on these technical polyisocyanates on the one hand and the simple polyols and/or polyetherpolyols and/or polyesterpolyols mentioned by way of example on the other hand, and any desired mixtures of such polyisocyanates. Isocyanates with aromatically bonded NCO groups are preferred according to the invention. A polyisocyanate component which is particularly preferred according to the invention is partly carbodiimidized diisocyanatodiphenylmethane, which also has uretonimine groups as a result of addition of monomeric diisocyanate onto the carbodiimide structure.

The water-hardening polyurethanes can contain catalysts which are known per se. These can be, in particular, tertiary amines which catalyze the isocyanate/water reaction and do not catalyze a self-reaction (trimerization, allophanatization) (DE-A-2,357,931). Examples which may be mentioned are polyethers containing tertiary amines (DE-A-2,651,089), low molecular weight tertiary amines, such as

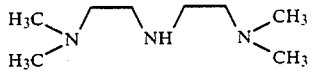

or dimorpholinediethyl ether or bis-(2,6-dimethylmorpholino)-diethyl ether (WO 86/01397). The content of catalyst, based on the tertiary nitrogen, is in general 0.05 to 0.5% by weight, based on the polymer resin.

Water-hardening polyvinyl resins can be, for example, vinyl compounds which consist of a hydrophilic prepolymer with more than one polymerizable vinyl group, into which a solid, insoluble vinyl redox catalyst is incorporated, one of its constituents being encapsulated by a water-soluble or water-permeable shell. Such a redox catalyst is, for example, sodium bisulphite/copper(II) sulphate, in which, for example, the copper sulphate is encapsulated in poly(2-hydroxyethyl methacrylate).

Polyvinyl resins are described, for example, in EP-A-0,136,021. Water-hardening polyurethanes are preferred.

The water-hardening synthetic resins can contain additives which are known per se, such as, for example, flow control auxiliaries, thixotropic agents, foam suppressants and lubricants.

The synthetic resins can furthermore be coloured or, if desired, contain UV stabilizers.

Examples of additives which may be mentioned are: polydimethylsiloxanes, calcium silicates of the Aerosil type, polywaxes (polyethylene glycols), UV stabilizers of the Ionol type (DE-A-2,921,163), and coloured pigments, such as carbon black, iron oxides, titanium dioxide or phthalocyanines.

The additives which are particularly suitable for polyurethane prepolymers are described in Kunststoff-Handbuch (Plastics Handbook), Volume 7, Polyurethanes, pages 100 to 109 (1983). They are in general added in an amount of 0.5 to 5% (based on the resin).

A process has also been found for the preparation of the textile sheet-like structures according to the invention with a water-hardening reactive resin, which is characterized in that the textile is prepared from organic fibers with an elasticity modulus in the range from 200 to 2,500 daN/mm$^2$, an extensibility in the longitudinal direction of more than 10% is established, and the textile is then impregnated and/or coated with the water-hardening synthetic resin.

The textile, that is to say the woven fabric or the knitted fabric, can be prepared in a manner which is known per se.

The extensibility in the longitudinal direction can preferably be established by heat shrinking or wet treatment. The heat shrinking procedure is known per se and can be carried out either in a drying oven with hot air or in special ovens with superheated steam. The residence time, in the heated region, of the material to be shrunk is in general 0.1 to 60 minutes, preferably 0.5 to 5 minutes.

The sheet-like structures according to the invention can particularly preferably be used for support dressings in the medical and veterinary medicine field. They are oustandingly comfortable when applied as a dressing, which is illustrated by the fact that they can be wound without creases around the difficult areas of the extremities of both humans and animals, such as the knee, elbow or heel.

The same applies to other fields of use in which they can be wound without folds around curved or angled mouldings.

Compared with the known bandages of glass fibres, the sheet-like structures according to the invention have the advantage of being lighter, coupled with their superior strength. In addition, they do not develop sharp edges, burn without leaving a residue and form no glass dust when removed with a saw and processed. A particular advantage is the increased X-ray transparency. In comparison with bandages of glass fibres, the sheet-like structures according to the invention do not break even under severe deformation.

The textile sheet-like structures according to the invention which are impregnated and/or coated with a water-hardening synthetic resin are in general stored in the absence of moisture.

EXAMPLE 1 (water-hardening synthetic resins)

The textile carrier materials (Example 2) are coated with the resins listed below.

Prepolymer I 100 parts of a technical polyphenyl-polymethylene-polyisocyanate obtained by phosgenation of an aniline-formaldehyde condensate ($\eta$ 25° C.=200 mPa.s; NCO content=31%), (crude MDI), are reacted with 32.2 parts of propoxylated triethanolamine (OH number=150 mg of KOH/g) to give a prepolymer with an NCO content of 20.0% and a viscosity of $\eta$ 25° C.=20,000 mPa.s. Catalyst content=0.30% of tertiary amine nitrogen.

Prepolymer II 660.0 parts of bis-(4-isocyanatophenyl)-methane containing carbodiimidized portions (NCO content=29%) are reacted with 3,400 parts of propoxylated triethanolamine (OH number=150 mg of KOH/g) to give a prepolymer. 1 part of a polydimethylsiloxane with a viscosity $\eta$ 25° C. of 11.24 mPa.s and 15 parts of a commercially available UV stabilizer (a cyanoalkylindole derivative) are also added. After the completed reaction, the prepolymer has a viscosity $\eta$ 25° C. of 23,000 mPa.s and an isocyanate content of 13.5%; it contains 0.45% of tertiary nitrogen.

Prepolymer III 6.48 kg of isocyanate bis(4-isocyanatophenyl)-methane containing carbodiimidized portions are initially introduced into a stirred kettle. 7.8 g of a polydimethylsiloxane with $\eta$ 25° C.=30,000 g/mol and 4.9 g of benzoyl chloride are then added, followed by 1.93 kg of a polyether (OH number 112 mg of KOH/g) prepared by propoxylation of propylene glycol, 1.29 kg of a polyester (OH number 250 mg of KOH/g) prepared by propoxylation of glycerol and 190 g of dimorpholinodiethyl ether. After 30 minutes, the reaction temperature reaches 45° C., and after 1 hour the temperature maximum of 48° C. is reached. 500 g of a polydimethylsiloxane with $\eta$ 25° C.=100 mPa.s are added and are stirred into the mixture. The viscosity of the finished prepolymer $\eta$ 25° C. is 15,700 mPa.s, and the isocyanate content is 12.9%.

Prepolymer IV 100 parts of a technical polyphenyl-polymethylene-polyisocyanate obtained by phosgenation of an aniline-formaldehyde condensate ($\eta$ 25° C.: 200 mPa.s; NCO content: 31% (crude MDI) are reacted with 32.2 parts of ethoxylated triethanolamine (OH number=149 mg of KOH/g) to give a prepolymer with an NCO content of 18.9% and a viscosity of $\eta$ 25° C.: 28,000 mPa.s. Catalyst content: 0.3% of tertiary amine nitrogen.

EXAMPLE 2 (carrier materials)

The characteristic data of the textile carrier material used are summarized in Table 1.

TABLE 1

(textile carrier materials)

| Carrier material | Composition* Overall type/% | Width cm | Longitudinal extension % | g/m$^2$ | Transverse extension % | Stitches course 10 cm | Stitches wale 10 cm |
|---|---|---|---|---|---|---|---|
| A | PES-TEX/PES-HF 27:73 | 8.6 | 37.5% | 115 | 80 | 56 | 49 |
| B | PES-TEXS/PES-HF 45:55 | 7.5 | 35.0% | 155 | 68 | 54 | 44 |
| C | PES-TEXS/PES-GL | 7.6 | 13% | 142 | 80 | 60 | 59 |

TABLE 1-continued (textile carrier materials)

| Carrier material | Composition* Overall type/% | Width cm | Longitudinal extension % | g/m² | Transverse extension % | Stitches course 10 cm | Stitches wale 10 cm |
|---|---|---|---|---|---|---|---|
| D | 59:41 PES-TEXS/PES-NS 38:62 | 7.5 | 24% | 244 | 74 | 50 | 59 |
| E | PES-TEXS/PES-HF 49:51 | 7.5 | 25% | 193 | 70 | 50 | 59 |
| F | PES-TEXS/PES-HF 42:58 | 7.5 | 25% | 230 | 48 | 50 | 59 |
| G | PES-TEX/BW 51:49 | 7.7 | 53% | 102 | 84 | 72 | 57 |
| H | PA1/PES-MF 31:69 | 7.9 | 18% | 172 | 60 | 55 | 57 |
| I | PES-TEX/PES-MF 19:81 | 9.0 | 16% | 170 | 45 | 50 | 59 |
| K | PA2/BW 46:54 | 7.9 | 26% | 79 | 74 | 53 | 58 |
| L | PES-TEX/PES-HF 31:69 | 11.0 | 62% | 118 | 90 | 51 | 49 |
| M | PES-TEXS/PES-ST 55:45 | 10.8 | 47% | 140 | 64 | 58 | 78 |
| V1 (comparison) | glass fiber (US-PS 4,609,578) | 7.5 | 19% | 291 | 66 | 56 | 51 |
| V2 (comparison) | cotton (EP-PS 90,289) | 7.5 | 0 | 64 | 310 | 35 | 60 |

*Note:
precise characterization of the yarn types is given in Table 2. All the data relate to the untreated material.

TABLE 2

| Characterization of the yarn types | |
|---|---|
| PES-TEXS: | 167 dtex, f 30 × 2, polyfilament texturized polyester filament yarn (HE yarn, K = 62%) |
| PES-TEX: | 167 dtex, f 30 × 1, polyfilament texturized polyester filament yarn (HE yarn, K = 60%) |
| PES-HF: | 550 dtex, f 96 VZ 60, polyfilament, high-strength polyester filament yarn, normally shrinking, E = 1650 daN/mm² |
| PES-GL: | 167 dtex, f 32 × 2, polyfilament polyester filament yarn |
| PES-NS: | 830 dtex, f 200, polyfilament, high-strength polyester filament yarn, normally shrinking, E = 1170 daN/mm² |
| PES-MF: | 550 dtex, f 96, polyfilament, high-strength polyester filament yarn, low-shrink, E = 980 daN/mm² |
| PES-ST: | 45 tex X 1, normal polyester spun yarn (staple fibre) |
| PA 1: | 110 dtex, f 34 × 2, polyfilament texturized polyamide filament yarn (HE yarn, K = 61%). |
| PA 2: | 78 dtex, f 17 × 2, polyfilament texturized polyamide filament yarn (HE yarn, K = 66%). |

K: characteristic crimp (DIN (German Standard Specification) 53 840)
E: elasticity modulus To achieve optimum longitudinal extension, the carrier material is subjected to heat shrinking, for example with steam at 110° C. for 5 minutes or in a drying cabinet with hot air at 135° C. for 10 minutes. If necessary, in addition to the actual processing step, the material is also dried at 110° to 190° C. in order to remove residues of moisture completely. Coating with the prepolymers I to IV is carried out in a dry booth, the relative humidity of which is characterized by a dewpoint of water of less than −20° C. Coating with the resin is carried out such that the weight of the desired length (for examle 3 m or 4 yards) of the textile knitted tape is determined and the amount of prepolymer required for sufficient adhesion is calculated and applied to the knitted tape. This coating can be carried out by dissolving the prepolymer in a suitable inert solvent (for example methylene chloride or acetone), impregnating the knitted tape with the solution and then removing the solvent in vacuo. However, the resin can furthermore also be applied via suitable roller impregnating units or slot dies. Such impregnation devices are described, for example, in U.S. Pat. No. 4,502,479 and U.S. Pat. No. 4,427,002. The level of the resin content depends on the particular intended use. For use as synthetic support dressings, the level of the resin content is 35 to 65%, whilst for technical uses as insulation or sealing, complete impregnation of all stitch openings may be desirable (application amount of more than 65%) (application amount based on the total weight). The coated tapes are cut to length and are then rolled up in the slack state and sealed in a film which is impermeable to water vapour. To produce the test specimens described in the following examples, the film bag is opened and the roll is dipped in water. The dripping wet roll is then wound in one operation to give the desired shaped article. The processing time of the polyurethane prepolymers preferred according to the invention is about 2 to 8 minutes. The longitudinal extension of the non-hardened coated tape is stated in Table 1.

EXAMPLE 3 (comparison example)

3.66 m of comparison material V1 weighing 79.9 g are coated with 51.1 g of prepolymer II, rolled up and packaged in the manner described above.

EXAMPLE 4 (comparison example)

3.00 m of comparison material V2 weighing 14.4 g are coated with 22.3 g of prepolymer I, rolled up and packaged, in the manner described above.

EXAMPLES 5 to 18

The following tapes are prepared and packaged analogously to 1 and 2

| Example | Carrier material | Length of the tape | Weight of the tape | Prepolymer | Weight of the prepolymer |
|---|---|---|---|---|---|
| 5 | A | 3.00 m | 24.6 g | II | 34.4 g |
| 6 | B | 3.00 m | 35.7 g | II | 42.8 g |
| 7 | C | 3.00 m | 39.7 g | II | 55.6 g |
| 8 | D | 3.00 m | 56.0 g | II | 56.0 g |
| 9 | E | 3.00 m | 44.2 g | II | 53.0 g |
| 10 | F | 3.00 m | 52.0 g | II | 57.2 g |
| 11 | G | 3.00 m | 23.3 g | I | 34.9 g |
| 12 | H | 3.66 m | 47.2 g | II | 42.4 g |
| 13 | I | 3.00 m | 48.4 g | II | 53.2 g |
| 14 | K | 3.00 m | 15.6 g | I | 23.7 g |
| 15 | A | 3.66 m | 32.6 g | III | 48.9 g |
| 16 | A | 3.66 m | 31.8 g | IV | 44.5 g |
| 17 | L | 3.66 m | 43.9 g | III | 65.9 g |
| 18 | M | 3.66 m | 54.8 g | III | 82.2 g |

EXAMPLE 19

6 test specimens with an internal diameter of 76 mm and consisting of 10 layers arranged flush on top of one another are wound. To determine the breaking strength, the test specimens are kept at 40° C. for 24 hours and then at 21° C. for 3 hours. They are then compressed in the radial direction (parallel to the cylindrical axis) between two plates in a pressure-extension machine (type Zwick No. 1484), the maximum force F and the associated deformation path being recorded (advance speed 50 mm/minute).

Results:

| Test specimen from Example * | $F_{max}$ [N] | Deformation path [mm] |
|---|---|---|
| 3 | 1300 | 15 |
| 4 | 377 | 18 |
| 12 | 840 | 60 |
| 11 | 833 | 50 |
| 13 | 1310 | 20 |
| 14 | 258 | 16 |

*excess tape is discarded.

EXAMPLE 20

6 test specimens which have an internal diameter of 45 mm and consist of 7 layers arranged flush on top of one another are wound. To determine the breaking strength, they are deformed to 20% analogously to Example 19 in a pressure-extension machine (9 mm). The force F required is determined.

Results:

| Test specimen from Example | Force F [N] measured at 20% deformation |
|---|---|
| 3 | 1050 |
| 4 | 180 |
| 7 | 1010 |
| 8 | 960 |
| 9 | 900 |
| 10 | 1120 |

EXAMPLE 21

5 test specimens which have an internal diameter of 76 mm and consist of 8 layers arranged flush on top of one another are wound. To determine the breaking strength, they are deformed analogously to Example 19 in a pressure-extension machine, the force at both 20% and 50% deformation being measured here.

Results:

| Test specimen from Example | Force F [N] measured at 20% deformation | at 50% deformation |
|---|---|---|
| 3 | 892 | 1052 |
| 4 | 185 | 264 |
| 5 | 236 | 447 |
| 6 | 404 | 587 |
| 12 | 370 | 770 |

Examples 19, 20 and 21 illustrate that longitudinally extensible textile carrier materials which consist of high-strength polyester fibres perform at the level of glass fibre tapes in respect of breaking strength, although they advantageously perform about ½ to ⅓ lower in terms of weight and even about 1/7 lower in respect of the E modulus.

Longitudinally extensible textile carrier materials aree thus entirely capable of replacing longitudinally extensible glass fibre carrier materials, since, in addition to their good breaking strength properties due to the longitudinal extensibility, they also have equally good properties when applied as a dressing, but do not have disadvantages such as poor X-ray transparency, sharp edges and dangerous glass dust.

EXAMPLE 22

2 test specimens are wound analogously to Example 19 and the breaking strength is determined at 20% and 50% deformation.

Results:

| Test specimen from Example | Force F [N] measured at 20% deformation | at 50% deformation |
|---|---|---|
| 15 | 220 | 349 |
| 16 | 223 | 376 |
| 17 | 280 | 435 |
| 18 | 163 | 175 (broken) |

The example shows that the breaking strength is independent of the type of resin (test specimens from Examples 15 and 16). Furthermore, it shows that high-strength, polyfilament polyester fibres are clearly superior to the normal polyester spun fibres (staple yarns) (test specimens from Examples 17 and 18).

What is claimed is:

1. Textile sheet-like structure impregnated or coated with water-hardening synthetic resin wherein said impregnated or coated structure is sealed in a film which is impermeable to water, said textile comprising organic fibers with an elasticity modulus of 200 to 2500 daN/mm$^2$ and having an extensibility in the longitudinal direction of at least 10% before hardening of said resin.

2. Textile sheet-like structures sealed in a film according to claim 1 comprising fibers with an elasticity modulus in the range from 400 to 2000 daN/mm$^2$.

3. Textile sheet-like structures sealed in a film according to claim 1 having an extensibility in the longitudinal direction of 15 to 200% before hardening of said resin.

4. Textile sheet-like structures sealed in a film according to claim 1 having an extensibility in the longitudinal direction of 15 to 80%.

5. Textile sheet-like structures sealed in a film according to claim 1 having an extensibility in the transverse direction of 20 to 300%.

6. Textile sheet-like structures sealed in a film according to claim 2 having a weight of 40 to 300 grams per square meter.

7. Textile sheet-like structures sealed in a film according to claim 1 which comprises polyester fibers, polyamide fibers, cotton fibers, or mixtures thereof.

8. Textile sheet-like structures sealed in a film according to claim 7 which comprise polyfilament polyester fiber textile material.

9. Textile sheet-like structures sealed in a film according to claim 7 which comprises polyfilament polyamide fiber textile material.

10. Textile sheet-like structures sealed in a film according to claim 1 wherein a polyurethane or polyvinyl resin is the water-hardening synthetic resin.

11. Textile sheet-like structures sealed in a film according to claim 10 wherein the resin is a prepolymer reaction product of polyphenyl-polymethylene-polyisocyanate obtained by phosgenation of an aniline/-formaldehyde condensate and propoxylated triethanol amine.

12. Textile sheet-like structures sealed in a film according to claim 10 wherein the resin is a prepolymer reaction product of bis-(4-isocyanatophenyl)-methane containing carbodiimidized portions and propoxylated triethanol amine.

13. Textile sheet-like structures sealed in a film according to claim 10 wherein the resin is a prepolymer reaction product of bis-(4-isocyanatophenyl)-methane and a mixture of propoxylated propylene glycol and propoxylated glycerol.

14. Textile sheet-like structures sealed in a film according to claim 10 wherein the resin is polyphenyl-polymethylene-polyisocyanate obtained by phosgenation of an aniline/formaldehyde condensate and ethoxylated triethanol amine.

15. Process for the preparation of textile sheet-like structures sealed in a film containing a water-hardening reactive resin, which comprises impregnating or coating a textile material with a water-hardening synthetic resin wherein said textile material is prepared from organic fibers with an elasticity modulus in the range from 200 to 2,500 daN/mm$^2$, with an extensibility in the longitudinal direction of more than 10% and sealing said impregnated material in a film which is impermeable to water.

16. Process according to claim 15 wherein the extensibility of the textile in the longitudinal direction is established by heat shrinking, wet shrinking, or both.

17. Process according to claim 16 wherein shrinking is carried out in the temperature range from 80° to 250° C.

18. Process according to claim 16 wherein the shrinking is by wet shrinking carried out by dipping or impregnating the sheet-like structure in a liquid medium.

19. Orthopedic support dressing material prepared from the textile sheet-like structures according to claim 1.

* * * * *